United States Patent [19]

Titus et al.

[11] Patent Number: 4,495,990

[45] Date of Patent: Jan. 29, 1985

[54] APPARATUS FOR PASSING ELECTRICAL CURRENT THROUGH AN UNDERGROUND FORMATION

[75] Inventors: Charles H. Titus, Newtown Sq.; John K. Wittle, Chester Springs; Christy W. Bell, Berwyn, all of Pa.

[73] Assignee: Electro-Petroleum, Inc., Wayne, Pa.

[21] Appl. No.: 427,708

[22] Filed: Sep. 29, 1982

[51] Int. Cl.[3] ..... E21B 43/00

[52] U.S. Cl. ..... 166/65 R; 174/6; 166/248; 219/277

[58] Field of Search ..... 166/65 R, 248, 234; 174/6; 219/213, 277, 278; 47/1.3

[56] References Cited

U.S. PATENT DOCUMENTS

| | | | |
|---|---|---|---|
| 3,149,672 | 9/1964 | Orkiszewski et al. | 166/39 |
| 3,211,220 | 10/1965 | Sarapuu | 166/248 |
| 3,547,193 | 12/1970 | Gill | 166/248 |
| 3,620,300 | 11/1971 | Crowson | 166/248 |
| 3,642,066 | 2/1972 | Gill | 166/248 |
| 3,724,543 | 4/1973 | Bell et al. | 166/248 |
| 3,908,256 | 9/1975 | Smith | 29/163.5 |
| 4,167,972 | 9/1979 | Sears | 166/233 |

FOREIGN PATENT DOCUMENTS

| | | | |
|---|---|---|---|
| 531223 | 12/1976 | U.S.S.R. | 174/6 |
| 604060 | 4/1978 | U.S.S.R. | 174/6 |

OTHER PUBLICATIONS

"Improving Earth-Ground Characteristics", Hoestenbach, Dec. 1976, Qst, pp. 16-17.

*Primary Examiner*—Stephen J. Novosad
*Assistant Examiner*—Mark J. DelSignore
*Attorney, Agent, or Firm*—Dann, Dorfman, Herrell and Skillman

[57] ABSTRACT

An apparatus for passing electrical current from a D.C. power source through an underground formation in the extraction of carbonaceous fluids from beneath the earth's surface comprises an anode and a cathode remote from the anode. The anode is comprised of a containment positioned proximate to the underground formation within which is placed layers of material suitable for conduction. First conductor means connect the conduction material and the first terminal of the D.C. power source. The cathode is comprised of a wire screen housing of electrically conductive material which is supported within a well bore proximate to the underground formation. Second conductor means connects the wire screen housing to the second terminal of the D.C. power source. Electrical current from the power source is passed along the first conductor means, through the anode, through the underground formation, through the cathode and back to the power source through the second conductor means.

13 Claims, 5 Drawing Figures

APPARATUS FOR PASSING ELECTRICAL CURRENT THROUGH AN UNDERGROUND FORMATION

BACKGROUND OF THE INVENTION

The present invention relates generally to an apparatus for passing electrical D.C. current through an underground formation in the extraction of carbonaceous fluids from beneath the earth's surface and, more particularly, to an anode and a cathode for employment in such an apparatus.

DESCRIPTION OF THE PRIOR ART

The production of gaseous and liquid hydrocarbons by passing electrical energy through underground carbonaceous formations, such as coal, oil, shale, and the like, has long been recognized as a means of avoiding the high costs and inefficiencies attendant fuel production by conventional methods which rely on traditional underground mining techniques. One of the problems inherent in the use of D.C. electrical energy for the production of such gaseous and liquid hydrocarbons is that the electrolysis involved in passing current through oil-bearing formations may bring about rapid deterioration of the electrodes involved.

The present invention overcomes the difficulties inherent with the previously known apparatus by providing a "surface" anode which provides positive, low-resistance contact between a power supply and a subterranean formation for the passage of electrical current therethrough. The anode provides for minimal energy loss and maximum life of the components.

The present invention also provides a cathode which effectively screens or retards the flow of sand and other formation materials in the well bore while facilitating the flow of oil and other such fluids through the pumping system.

SUMMARY OF THE INVENTION

Briefly stated, the present invention comprises an apparatus for passing electrical current from a D.C. power source through an underground formation for the purpose of extraction of carbonaceous fluids or gases from beneath the earth's surface. The apparatus comprises a surface anode and a cathode in the formation remote from the anode. The anode is comprised of a containment positioned proximate to the earth's surface and a first layer of material suitable for conduction positioned in the containment. A second layer of material also suitable for conduction is positioned in contact with the first layer of conduction material. A first conductor means connects the second layer of conduction material and the first terminal of the power source for supplying a flow of electrical current to the anode. A layer of insulator material is positioned between the second layer of conduction material in the containment and the atmosphere. The cathode is comprised of a wire screen housing of electrically conductive material positioned proximate to the underground formation. Means are provided for supporting the screen housing at a predetermined position within a well bore and second conductor means are provided to connect the wire screen housing to the second terminal of the power source. Electrical current from the power source is passed along the first conductor means, through the anode, through the underground formation, through the cathode, and along the second conductor means back to the other terminal of the power source.

BRIEF DESCRIPTION OF THE DRAWINGS

The foregoing summary as well as the following detailed description of a preferred embodiment of the present invention will be better understood when read in conJunction with the accompanying drawings, in which.

DESCRIPTION OF THE PREFERRED EMBODIMENT

Figure 1:
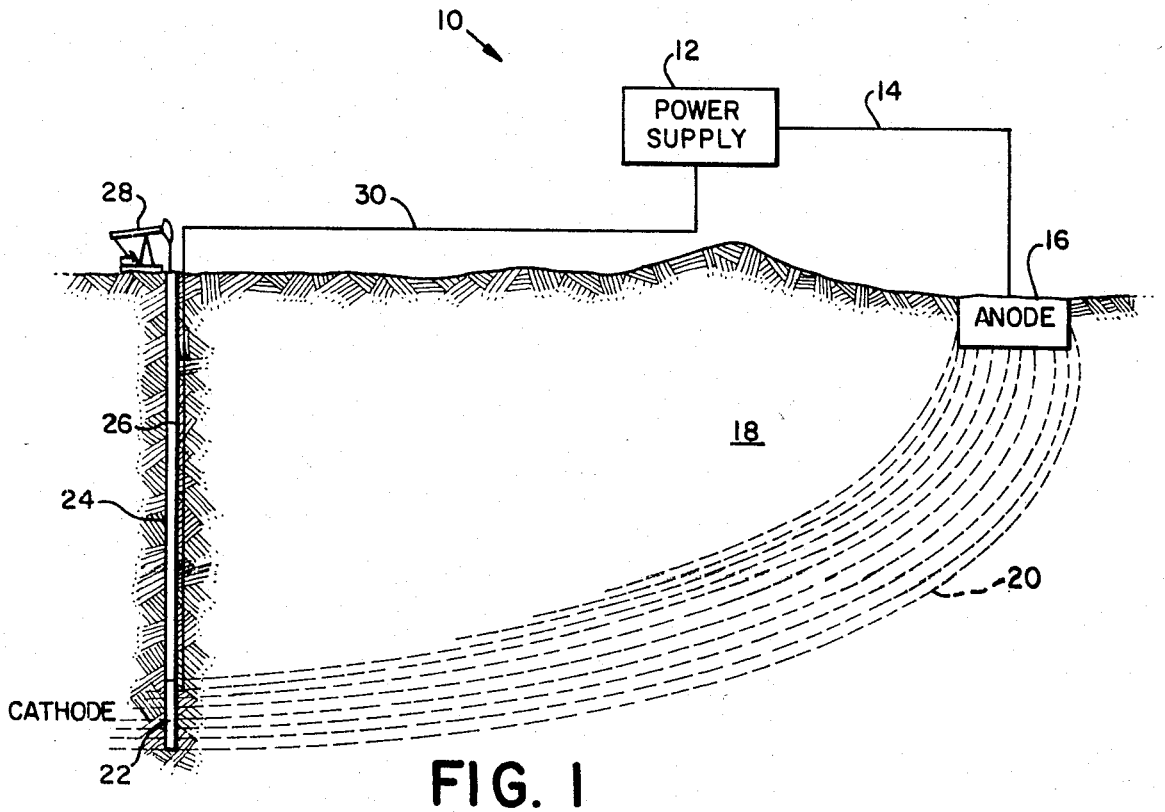
FIG. 1. is a cross-sectional view through an underground formation of carbonaceous and other materials showing the apparatus of the present invention.

Referring to the drawings, and particularly to FIG. 1, there is shown a cross-sectional view through an underground formation or deposit of carbonaceous material showing a schematical representation of the apparatus 10 of the present invention. In the present embodiment, the carbonaceous material which is contained within the underground formation and is sought to be recovered is oil. However, it should be understood that the present invention is not limited to the recovery of oil but, could also be used in connection with the recovery of other carbonaceous fluids such as natural gas.

The apparatus 10 is comprised of a power supply 12, a first terminal of which is connected by a suitable first conductor means or insulated cable 14 to a surface electrode 16. In the present embodiment, the positive (+) terminal of the power supply 12 is connected to the electrode 16, thereby making the electrode an anode. The D.C. power supply 12 is comprised of suitable step-down transformers, circuit breaker, power regulator, and rectifier components (not shown) of a type well known in the art for supplying a well regulated D.C. voltage and current at the required levels. The power supply 12 may receive its external power from any three-phase conventional source such as from a 13.8 KV line of a commercial power company (not shown).

The surface anode 16 receives the current flow from the power supply 12 and operates to pass the current into the underlying ground formation 18. The underground formation 18 may include overburden and underburden as well as the carbonaceous containing material. A current path, represented in FIG. 1 by dashed lines 20 is established within the underlying ground formation 18 between the surface anode 16 and a subsurface or "down hole" electrode or cathode 22. The current is passed through the underlying ground formation between the surface anode 16 and the cathode 22 through an aqueous electrolytic solution which is contained within the underlying ground formation 18. In most instances, connate water within an underground formation contains various dissolved salts, thereby providing a natural aqueous electrolyte solution. Where the underlying ground formation tends to be dry, as in the case of a shale oil formation, a suitable electrolyte solution may be injected into the formation in the vicinity of the cathode 22.

The cathode 22 is located within a well bore 24 which extends downwardly from the earth's surface and penetrates a subterranean formation of carbonaceous material, in the present embodiment oil. The well bore 24 is provided with a generally cylindrical pressure-resistant tubular casing 26 of a type well known in the art which is comprised of a plurality of sections or segments which are joined together end-to-end to form a generally continuous tubular casing which extends from the surface to at least the top of the oil-bearing formation. The well bore casing 26 may be fabricated of electrically insulated or electrically conductive materials of the type well known in the art for fabrication of such casings. The upper end of the casing 26 may be connected to a suitable pumping system 28 for the removal of fluids, such as oil, from the well bore 24. The pumping system 28 is also of a type well known in the art. The lower end of the casing 26 may include a plurality of perforations (not shown) to permit the injection of fluids into or the withdrawal of fluids from the well bore 24 by the pumping system 28.

The cathode 22 is generally tubular and is attached to and supported by the casing 26 at a desired position within the oil-bearing formation. Suitable insulation may be provided between the cathode 22 and the adjacent portion of the casing 26 in order to electrically isolate the cathode 22 from the casing 26, thereby avoiding possible electrical short circuits. A suitable second conductor means or insulated cable 30 connects the cathode 22 with the second (or negative) terminal of the power supply 12.

The apparatus 10 as shown on FIG. 1 and as thus far described provides a complete electrical circuit for the flow of current from the power supply 12 through the surface anode 16, through the electrolytic solution within the underlying oil-bearing formation 18, through the cathode 22 and back to the power supply 12. By passing electrical current through an oil-bearing formation 18 in this manner, the oil is heated to thereby reduce its viscosity and facilitate its subsequent recovery and removal by the pumping system 28. A detailed description of the specific manner and process in which the passage of electrical current through the underlying ground formation facilitates the recovery of oil or other such carbonaceous material will not be presented herein since it is not necessary for a complete understanding of the structure and use of the present invention. However, such a detailed description of the method and operation of the current flow may be obtained by referring to our co-pending U.S. patent applications Ser. No. 242,277, entitled "In Situ Gasification", and Ser. No. 427,714, entitled "In Situ Method for Yielding a Gas From a Subsurface Formation of Hydrocarbon Material" and U.S. Pat. Nos. 3,782,465, entitled "Electrothermal Process for Promoting Oil Recovery" and 3,724,543 entitled "Electrothermal Process for Production of Off-Shore Oil Through On-Shore Wells", all of which are hereby incorporated herein by reference.

Figure 2:
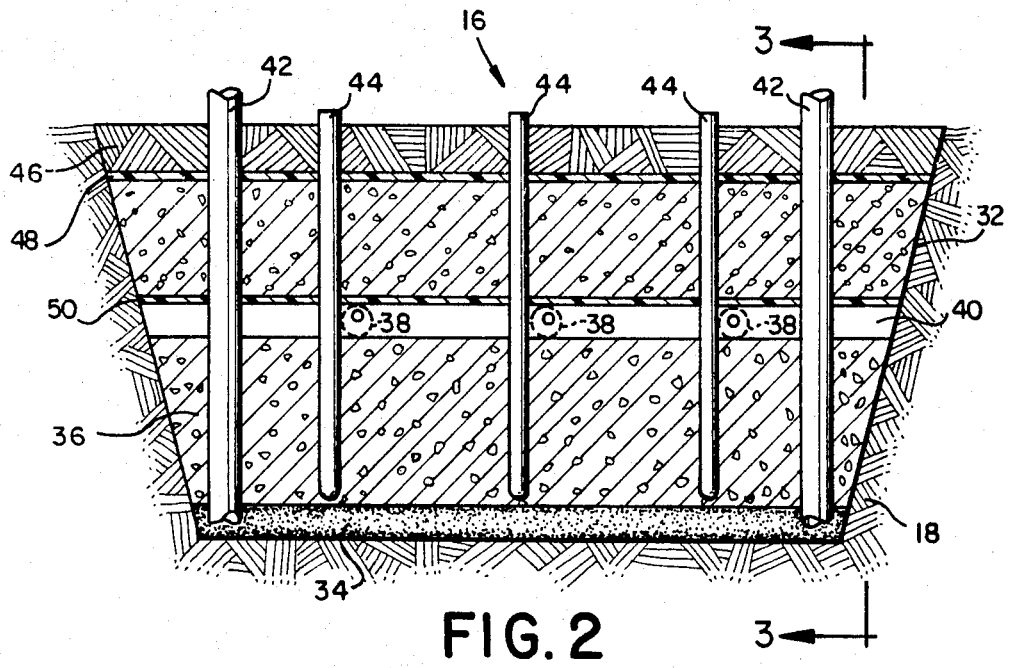
FIG. 2 is a sectional elevation view of the anode portion of FIG. 1.
Figure 3:
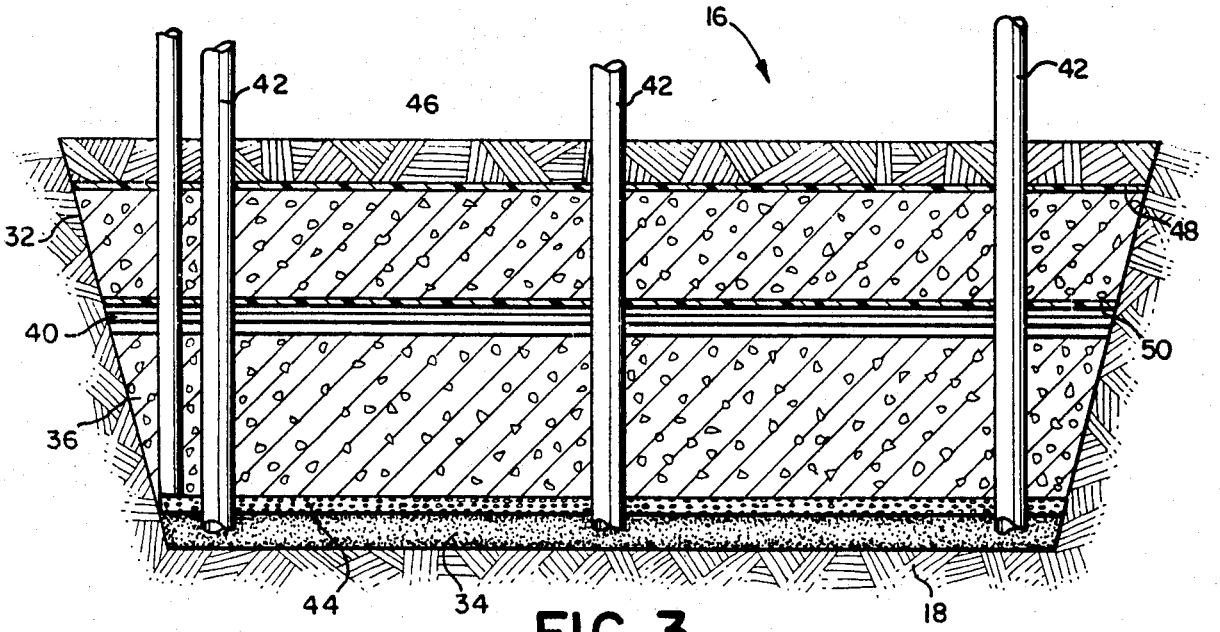
FIG. 3 is a sectional view of the anode taken along line 3—3 of FIG. 2.

Referring now to FIGS. 2 and 3, there is shown a more detailed schematic illustration of the surface anode 16. As shown, the anode 16 is comprised of a containment 32 positioned proximate to the underground formation 18, in the present embodiment, an elongated trench within the earth's surface. In the present embodiment, the containment 32 is approximately eight feet wide, six feet deep and is approximately 100 feet in length.

A first layer of material suitable for effectively supplying electrolyte for conduction, in the present embodiment rock salt 34, is positioned within the containment 32, in the present embodiment, along the bottom of the containment so as to be in direct contact with the aqueous electrolytic solution located within the underlying ground formation 18. Although rock salt is employed in the present embodiment, it should be appreciated that an aqueous solution or any other material which is suitable for ionic conduction may alternatively be employed.

A second layer of material suitable for effective electronic conduction, in the present embodiment a carbonaceous material such as graphite or crushed coke 36, is positioned in direct contact with the ionic conduction material layer 34, in the present embodiment, on top of the ionic conduction material layer. Carbonaceous material such as coke is employed in the present embodiment because such material is a good, low-cost conductor which has a relatively long service life.

Conductor means, in the present embodiment, a plurality of metal pipes 38 (only three of which are shown), extend along the length of the anode 16 approximately through the middle of the coke layer 36. The metal conductor pipes 38 are connected by cable 14 to the positive terminal of the power supply 12 as shown schematically on FIG. 1. The metal conductor pipes 38 receive current from the power supply 12 and transmit the current by electronic conduction to the coke layer 36 along the entire length of the pipes. In this manner, the coke layer 36 isolates the metal conductor pipes 38 from the electrolytic chemical reaction occurring between the ionic conduction layer 34 and the electrolytic solution within the underlying ground formation 18.

In order to enhance or improve the efficiency of the current flow from the metal pipes 38 to the coke layer 36, the portion of the coke layer immediately adjacent to the metal pipes 38 may comprise a sublayer of very finely ground coke or coke breeze 40. The coke breeze sublayer 40 provides for increased surface area contact between the coke layer and the metal pipes 38, thereby providing for a more continuous and efficient current flow.

Conduit means, in the present embodiment a plurality of generally vertical pipes 42, extend from the ionic material layer 34 to the surface. The pipes 42 may be connected to a suitable surface-mounted pumping system (not shown) for the purpose of injecting water or other liquids into or removing water or other such liquids from tho ionic material layer 34. It is necessary to keep the ionic material layer 34 wet to insure that there is efficient conduction between the anode 16 and the underlying ground formation 18 with a minimal voltage drop or energy loss at the anode/ground formation interface. It is also important to keep the upper portion of the carbonaceous layer 36 dry, particularly in the vicinity of the metal conductor pipes 38 to prevent premature deterioration of the metal of the pipes.

In order to insure that the level of water or other such liquids within the ionic material layer 34 is appropriate to promote efficient, low loss conduction without significant deterioration of the anode structure, the anode 16 includes perforated pipes 44 (three of which are shown) which run generally horizontally along the length of the anode 16 just above the ionic material layer 34. One end of each of the perforated pipes 44 extends vertically upwardly to communicate with the surface as shown. This vertical portion of 44 is *not* perforated. Positioned within each of the pipes 44 are sensor means (not shown). The sensor means are provided to monitor the level of the water or other such liquids which enter the pipes 44 through the perforations. The level of the water or other such liquids within the pipes 44 provides an indication of the liquid level within the ionic material layer 34 and the lower portion of the carbonaceous layer 36. The sensor means may be connected to the surface-mounted pumping system (not shown) to actuate one or more pumps (not shown) to inject or remove such liquids into or from the ionic material layer 34 in order to maintain a desired liquid level therein.

A layer of material, in the present embodiment a layer of dirt 46, is positioned between the coke layer 36 and the surface. The purpose of the dirt layer 46 is to isolate the anode from the surface. By covering the upper surface of the anode with dirt in this manner and planting the dirt with grass, the penetration of the coke by unwanted ground and run off water be minimized. In addition, a layer of moisture resistant material such as polyethylene 48 may be positioned between the dirt layer 46 and the coke layer 36. A second layer of polyethylene 50 may be positioned above the metal pipes 38. The purpose of the two polyethylene layers 48 and 50 is also to prevent ground water from passing into and through the anode 16.

As discussed briefly above, the surface anode 16 is designed to provide for efficient and inexpensive conduction of electrical energy into the underlying ground formations. The efficient transfer of current is accomplished by having the current flow by conduction from the metal pipes 38 to the coke breeze and coke layer 36. The current then flows from the coke layer 36 through the salt layer 34 and into the electrolytic solution as shown on FIG. 1. The low resistance conduction is necessary in order to properly utilize the current flow in the oil recovery and removal process. However, if the anode 16 employed only the metal pipes 38 for conduction, the anode structure and particularly the metal pipes 38 would be eroded or used up in a relatively short period of time due to electrolysis. By employing conduction of the current from the power supply 12 to the coke layer 36 within the anode 16 and thereafter from the coke layer within the anode to the electrolytic solution as shown and described, the efficient transfer of current to the electrolytic solution is accomplished without significant irreplaceable errosion of the anode structure.

An anode of the type described and shown may have an effective resistance of less than 0.1 ohm, thereby providing for only a small voltage drop or energy loss. A single anode 16 may be employed to provide simultaneous or sequential current paths for a plurality of different wells having different cathodes (not shown).

Figure 5:
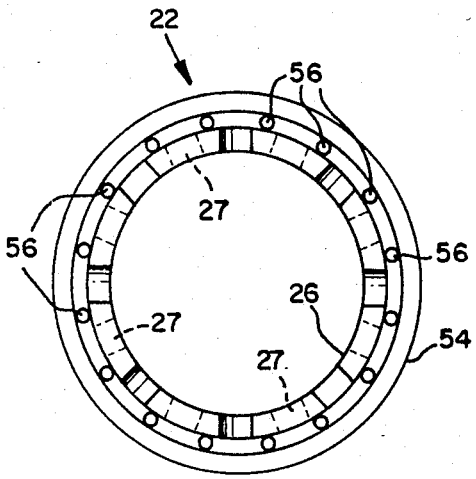
FIG. 5 is a sectional view of the cathode of FIG. 4.
Figure 4:
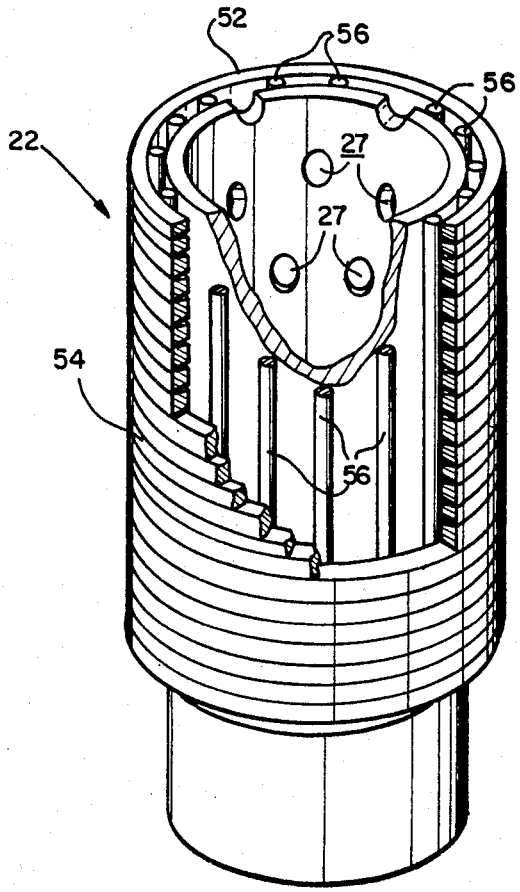
FIG. 4 is an enlarged perspective view, partially broken away, of the cathode of FIG. 1.

Referring now to FIGS. 4 and 5, there is shown in more detail the cathode 22. As shown, the cathode 22 is comprised of a generally cylindrical sleeve-like wire screen housing 52 comprised of steel or any other suitable electrically conductive material. The wire screen 52 is positioned proximate to the electrolytic solution and the oil-bearing formation (see FIG. 1). The wire screen housing 52 may be formed in any known manner but in the present embodiment, comprises a single continuous strand of steel wire 54 wrapped in a helical fashion to form a cylinder, the wire being spaced apart at different levels of the helix to provide passages therebetween of a predetermined size. As shown, the wire 54 is wrapped around the well casing 26. In the present embodiment a plurality of generally vertical ribs 56 are interposed between the wire 54 and the well casing 26 in order to electrically connect the wire screen housing 52 to the steel casing 26 and to effect channels for the flow of liquids into the well bore. As shown, the well casing 26 includes a plurality of perforations or openings 27 in the vicinity of the wire screen housing 52.

By properly establishing the distance between the wire 54 of the wire screen housing 52, the housing excludes sand and other such formation particles while at the same time freely admitting the lowered viscosity oil which then passes through the casing openings 27 and is pumped to the surface by the pumping system 28. In the present embodiment, the passages between the wires are on the order of 0.015 inch wide. The passage of electrical current through the wire screen housing significantly enhances the flow of the viscous oil through the casing openings for eventual recovery. In addition, by excluding sand and other such formation materials, potential pump and flow line plugging is decreased while at the same time oil production may be significantly increased.

From the foregoing description, it can be seen that the present embodiment provides an apparatus for efficiently passing electrical current from a D.C. power source through an underground formation in the extraction of carbonaceous fluids from beneath the earth's surface. It will be recognized by those skilled in the art that changes or modifications may be made to the above-described embodiment without departing from the broad inventive concepts of the invention. It is understood, therefore, that this invention is not limited to the particular embodiment described and shown, but it is intended to cover all changes and modifications which are within the scope and spirit of the invention as set forth in the appended claims.

We claim:

1. An anode for use in a system in which electrical current from a first terminal of a D.C. power source is passed through an underground formation to a cathode remote from the anode which is connected to the second terminal of the power source in the extraction of carbonaceous fluids from beneath the earth's surface, the anode comprising:

a containment positioned proximate to the underground formation;

a first layer of generally wet conduction material suitable for ion conduction positioned in the containment to enhance conduction between the anode and the underground formation, the containment permitting conduction between the first layer of conduction material and the underground formation;

conductor means connected with the first terminal of the power source for providing a flow of electrical current for the anode; and a second layer of generally dry conduction material positioned in the containment in contact with the first layer of conduction material and generally surrounding the conductor means to isolate the conductor means from the first layer of material and the underground formation to prevent deterioration of the contuctor means by electrolysis;

whereby electrical current from the power supply is passed through the conductor means, the second layer and the first layer and into the underground formation.

2. An apparatus for passing electrical current from a D.C. power source having first and second terminals through an underground formation in the extraction of carbonaceous fluids from beneath the earth's surface, the apparatus comprising an anode and a cathode remote from the anode, the anode comprising:

a containment positioned proximate to the underground formation;

a first layer of generally wet conduction material suitable for ion conduction positioned in the containment to enhance conduction between the anode and the underground formation, the containment permitting conduction between the first layer of conduction material and the underground formation;

conductor means connected with the first terminal of the power source for providing a flow of electrical current for the anode; and a second layer of generally dry condition material positioned in the containment in contact with the first layer of conduction material and generally surrounding the conductor means to isolate the conductor means to prevent deterioration of the conductor means by electrolysis; the cathode comprising:

a screen housing comprised of an electrically conductive material, the screen housing positioned within a well bore proximate to the underground formation;

means for supporting the screen housing at a predetermined position within the well bore; and second means connecting the screen housing to the second terminal of the power source for conducting current from the screen housing to the power source, whereby electrical current from the power source is passed through the conductor means, the anode, the underground formation, the cathode, and the second means and back to the power source.

3. The apparatus as recited in claims 1 or 2 wherein the first layer of conduction material comprises a salt.

4. The apparatus as recited in claims 1 or 2 wherein the second layer of conduction material comprises crushed coke.

5. The apparatus as recited in claim 4 wherein the conductor means comprises pipe means extending through the coke layer.

6. The apparatus as recited in claim 5 wherein the coke layer further includes a sublayer of finely ground coke breeze adjacent the pipe means for providing improved electrical contact.

7. The apparatus as recited in claim 2 wherein the means for supporting the screen housing comprises a well bore casing.

8. The apparatus as recited in claims 1 or 2 further comprising means for maintaining the first layer of conduction material generally wet and the second layer of conduction material generally dry.

9. The apparatus as recited in claim 8 wherein the means for maintaining the first layer of conduction material wet and the second layer of conduction material dry comprises conduit means communicating with the first layer of conduction material to inject the withdraw liquids into and out of the first layer of conduction material.

10. The apparatus as recited in claims 1 or 2 wherein the means for maintaining the first layer of conduction material wet and the second layer of conduction material dry comprises conduit means having a porous portion disposed in communication with the first and second layers of conduction material to provide access for monitoring the level of liquids within the first and second layers.

11. The apparatus as recited in claims 1 or 2 further comprising a layer of moisture resistant insulator material disposed between the second layer of conduction material in the containment and atmosphere to prevent penetration of liquids into the second layer of conduction material.

12. The apparatus as recited in claim 11 further comprising a layer of dirt disposed between the layer of insulator material and atmosphere.

13. The apparatus as recited in claim 6 further comprising a layer of moisture resistant insulator material disposed between the sublayer of the coke breeze and atmosphere to prevent penetration of liquids into the sublayer of coke breeze.

* * * * *